US005669496A

United States Patent [19]

Daniels

[11] Patent Number: 5,669,496

[45] Date of Patent: Sep. 23, 1997

[54] MAIN-TOP PACKAGE

[75] Inventor: Joseph C. Daniels, Ashland City, Tenn.

[73] Assignee: White Consolidated Industries, Inc., Cleveland, Ohio

[21] Appl. No.: 500,431

[22] Filed: Jul. 10, 1995

[51] Int. Cl.[6] ..... B65D 85/00

[52] U.S. Cl. ..... 206/320; 206/593

[58] Field of Search ..... 206/320, 588, 206/591, 592, 593, 594, 524.9

[56] References Cited

U.S. PATENT DOCUMENTS

| | | | |
|---|---|---|---|
| 2,797,800 | 7/1957 | Sider . | |
| 2,808,978 | 10/1957 | Wright et al. . | |
| 3,279,677 | 10/1966 | Wojcik | 206/594 X |
| 4,762,226 | 8/1988 | Gatton . | |
| 4,811,840 | 3/1989 | Muyskens . | |
| 4,832,190 | 5/1989 | Favreau . | |
| 5,050,731 | 9/1991 | Baynes et al. . | |
| 5,249,678 | 10/1993 | Traina . | |
| 5,307,928 | 5/1994 | Bishop . | |
| 5,341,934 | 8/1994 | Hsu | 206/591 |

*Primary Examiner*—Jacob K. Ackun

*Attorney, Agent, or Firm*—Pearne, Gordon, McCoy & Granger LLP

[57] ABSTRACT

A shipping restraint for appliance accessories having first and second ends and a main section intermediate said ends. The first end is received by a door of the appliance. The second end spaces a portion of the main section from the remainder of the main section. The main section includes two end apertures, the tabs extending through the apertures and defining a framework to retain the accessories during shipment. A reinforcement member is removably secured to the main section and serves to support a shipping box surrounding the appliance.

7 Claims, 3 Drawing Sheets

MAIN-TOP PACKAGE

BACKGROUND OF THE INVENTION

The present invention generally relates to shipping restraints and, more specifically, to shipping restraints used in conjunction with household ranges and range accessories.

It is common to place necessary range accessories, such as oven racks, broiler pans and finishing parts, in separate boxes which are taped or secured to the interior or exterior of the appliance. This is due to the fact that the racks and pans will move around and possibly damage themselves or the range finish if left unrestrained within the range during shipment.

Another problem encountered in shipping ranges is that, when the appliance is loaded into the shipping box, there is an unsupported space between a top panel of the appliance and a top wall of the box. There also is an open space in the front of the range. Specialized interior or exterior supports may be necessary to prevent the box from collapsing.

However, separately packaging the range accessories and providing specialized exterior or interior box supports increases the shipping cost of the appliance and the resulting packaging waste. Therefore, there exists a need in the art for a device for restraining the range accessories during shipment. There also exists a need for such a device which will provide support for the shipping box to prevent collapse thereof.

SUMMARY OF THE INVENTION

The present invention is directed toward a device for restraining accessories which also serves as a supplemental support for a portion of an appliance shipping box and as a cushion to prevent or minimize damage to the appliance during shipment.

In accordance with the present invention, a shipping restraint for use with a domestic appliance is formed in one piece and has a first end, a second end opposite the first end, and a main section intermediate the first and second ends. The first end is adapted to be received by a portion of the appliance. The second end is operable to space a portion of the shipping restraint a distance from the appliance. The main section includes means for releasably restraining portable appliance accessories during shipment.

In further accordance with the present invention, the main section includes a series of tabs and corresponding slotted apertures. The tabs project upwardly through the slotted apertures and cooperate with a further tab provided by the main section to define a framework for restraining the accessories for shipment.

In further accordance with the present invention, a reinforcement member is releasably secured to the main section. The reinforcement member includes projections which fit within the slotted apertures in the main section. The reinforcement member provides support for a shipping box surrounding the appliance.

BRIEF DESCRIPTION OF THE DRAWINGS

These and further features of the present invention will be apparent from the following description and drawings, wherein.

DETAILED DESCRIPTION OF THE DRAWINGS

Figure 1:
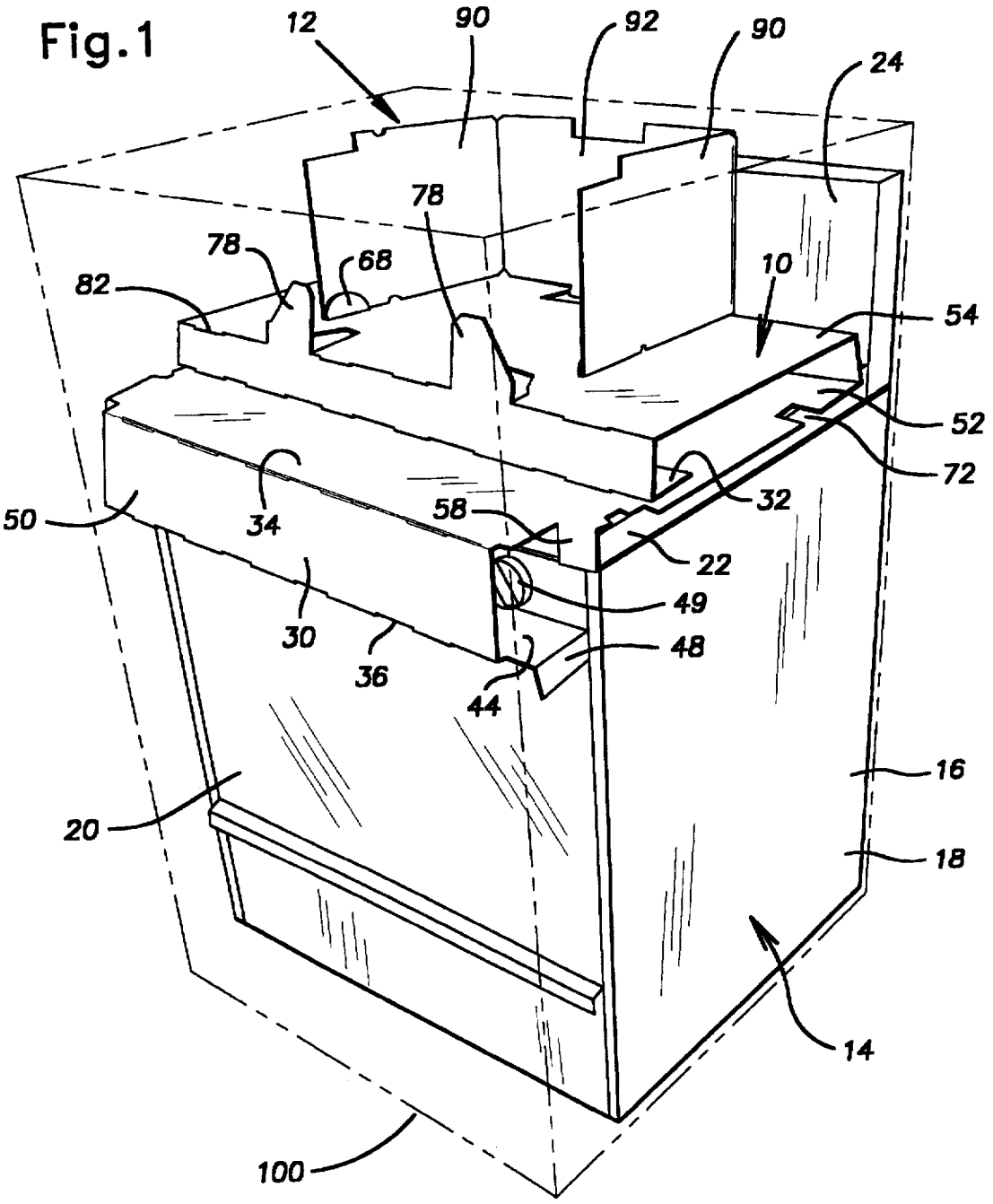
FIG. 1 is a perspective view of a household range with a shipping restraint and a reinforcement member according to the present invention secured thereto and with a shipping box shown in phantom.
Figure 2:
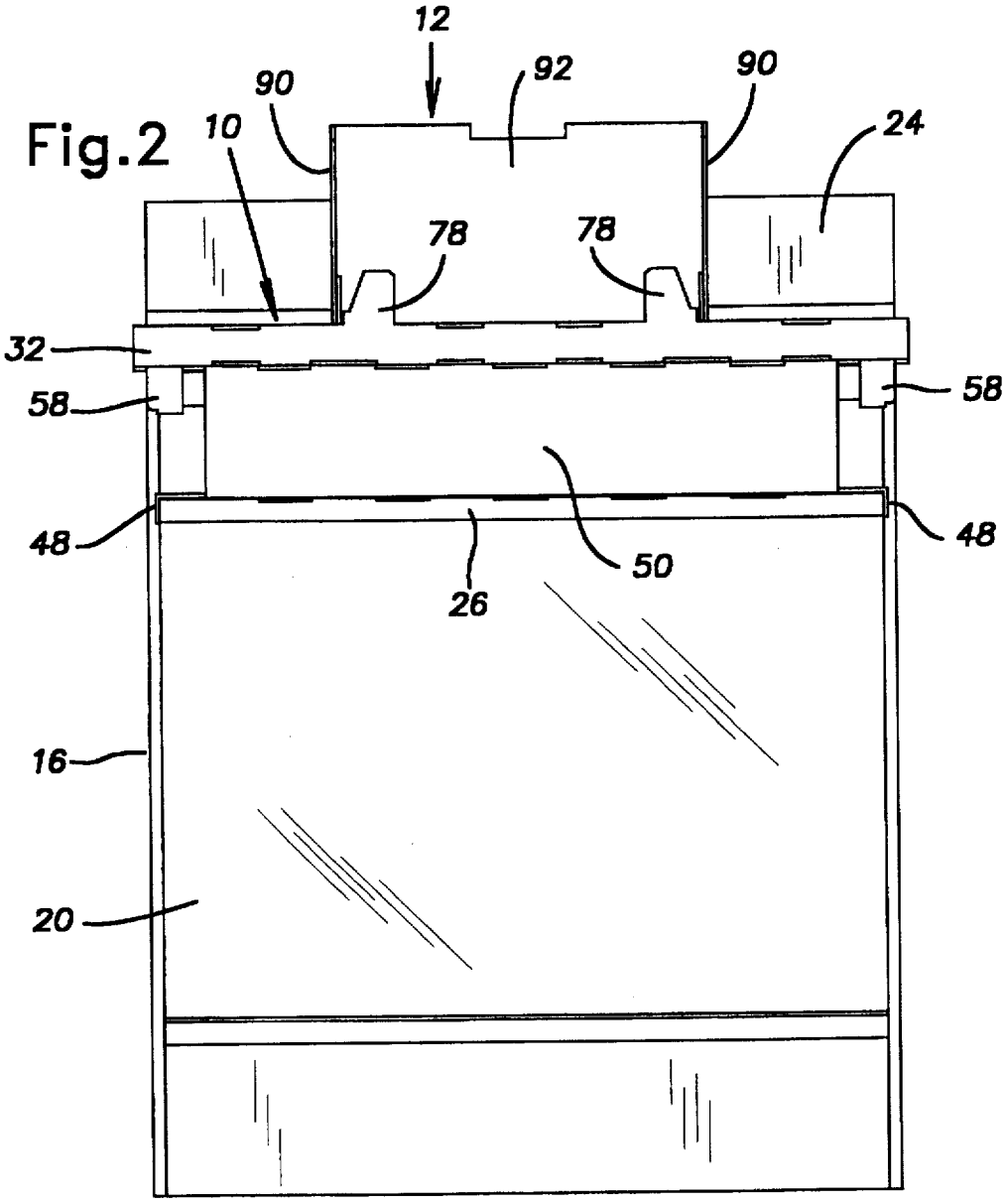
FIG. 2 is a front elevational view of the shipping restraint, reinforcement member, and appliance shown in FIG. 1.
Figure 3:
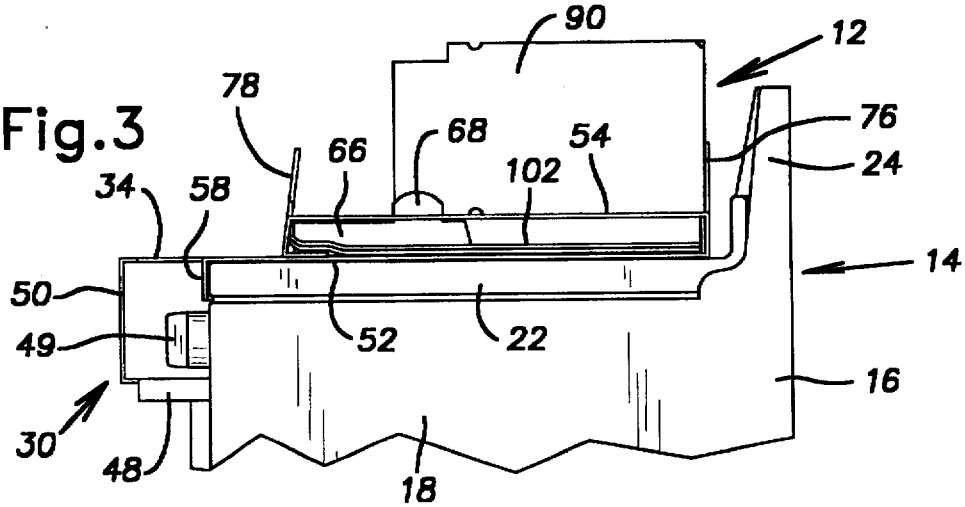
FIG. 3 is a side elevational view of the shipping restraint, reinforcement member, and appliance shown in FIG. 1.

With reference to FIGS. 1–3, a shipping restraint 10 and reinforcement member 12 according to the present invention are shown secured to a domestic gas range 14. The range 14 has a cabinet 16 including a pair of lateral sidewalls 18 (one shown), an oven door 20, a main top panel 22, and a rearwardly mounted control console 24. The top panel 22 has a series of openings (not shown) formed therein for receipt of gas burners for a gas range top, or coiled resistance-type heating elements for an electric range top. Alternatively, the top panel 22 may have a smooth top surface provided with a planar electrical heating element, as is known in the art. The top panel 22 may be pivotable upwardly about its rear edge to permit access to the space therebeneath for purposes of cleaning.

The oven door 20 is pivotally mounted about its lower edge for movement about a horizontal axis, and may include a manually or automatically operated locking device to prevent opening of the door 20 during operation of the oven in a selfcleaning mode. A handle 26 (FIG. 2) generally extends the full width of the door 20.

Figure 4:
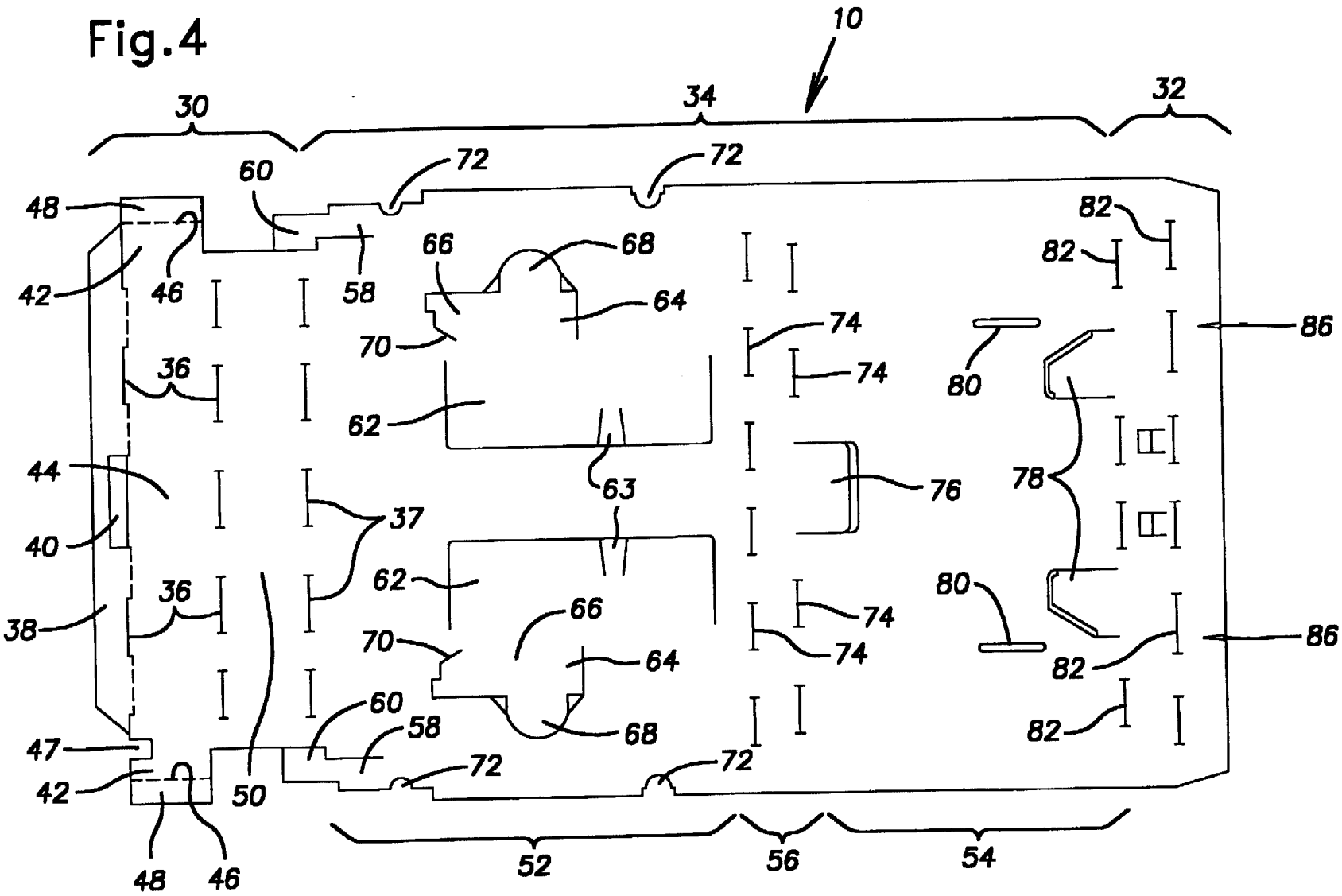
FIG. 4 is a top plan view of the shipping restraint according to the present invention.

With reference to FIG. 4, the shipping restraint 10 integrally includes a first end 30, a second end 32, and a main section 34 intermediate the first and second ends 30, 32. The first end 30 includes a pair of perforated fold lines 36 which permit the first end 30 to bend or fold in a prescribed fashion. A further perforated fold line 37 exists between the first end 30 and the main section 34.

A distal portion 38 of the first end 30 defines an aperture 40 which, as will be described more fully hereafter, is adapted to receive the oven door locking device. Ears 42 extend laterally from a mid-portion 44 of the first end 30 and include longitudinally directed perforated fold lines 46 to permit an outer portion 48 of the ears to be bent over an outer edge or corner of the oven door 20, as shown best in FIGS. 1 and 3. A notch 47 is formed in the mid-portion adjacent one of the ears 42, as illustrated, and provides clearance to allow the first end 30 to clear a light switch (not shown) provided by the cabinet 16 and actuated by the door 20. The mid-portion 44 also overlies and protects the top surface of the door 20.

A proximal portion 50 of the first end 30 (i.e., closest to the main section 34) is smaller in a width dimension than the remainder of the first end 30 or the main section 34, as illustrated, and defines a cut-out (when assembled) that is adapted to receive a corner post (not shown) that protects the front corners of the range 14. The proximal portion 50 defines a generally vertical plane or surface in use, and overlies and protects the front portion of the main top panel 22 and a portion of the cabinet 16 above the door 20 (FIGS. 1–3), which may include control dials or knobs 49.

The main section 34 includes a lower portion 52 and an upper portion 54 which are connected by a connecting portion 56. The upper and lower portions 52, 54, as will be described hereafter, cooperate to define a partially enclosed space which is adapted to receive range accessories for shipment.

The lower portion 52 extends from the first end proximal portion 50 and rests upon an outer surface of the appliance top panel 22 (FIGS. 1, 3). A pair of lateral tabs 58 extend longitudinally from the lower portion 52, are bent around the top panel 22, and include a distal portion 60 which is received between the top panel 22 and the upper surface of the cabinet 16 (i.e., the top of the lateral sidewalls 18) if the top panel 22 is pivotally mounted. The distal portion 60 thus serves as a cushion or spacer to prevent damaging rubbing or banging between the top panel 22 and the cabinet 16 during shipment. If the top panel 22 does not pivot about its rear edge, the distal portion 60 of the tabs 58 merely hangs down in front of the appliance.

The lower portion 52 also provides inner and outer pairs of tabs 62, 64. The inner tabs 62 include, at an inner portion thereof, ear members 63. In use, the inner tabs 62 are folded under the lower portion 52, and the ear members 63 are inserted into receiving slots 65 formed in the lower portion. The ear members 63 thus retain the inner tabs 62 in position between the lower portion 52 and the main top panel 22, allowing the inner tabs 62 to serve as a cushion.

The outer pair of tabs 64 have a generally rectangular base 66 which is attached to the lower portion 52 and from which a semi-circular projection 68 extends. One side of the rectangular base has a notched bottom edge 70 adjacent the lower portion 52, as illustrated. As will be described more fully hereafter, the outer tabs 64 help to secure the upper portion 54 to the lower portion 52.

Each lateral side of the lower portion 52 has two notched recesses 72. The recesses 72 are included to facilitate adhesively attaching the lower portion 52 to the top panel 22 by tape or the like, as will be described more fully hereafter.

The connecting portion 56 is a short extension between the upper and lower portions 54, 52 and is bounded by perforated fold lines 74. The connecting portion 56 defines the spacing between the upper and lower portions 54, 52.

The upper portion 54 of the main section 34 has a large, centrally located tab 76 adjacent the connecting portion 56. The central tab 76 extends upwardly and away from the appliance. The upper portion 54 also provides a pair of upwardly extending tabs 78 which cooperate with the central tab 76 to define a framework for supporting the top of the box 100 should the reinforcement member 12 not be necessary, as is the case on appliance models having a relatively shorter control console 24 than shown in the present drawing figures.

A pair of spaced apart slots 80 are also formed in the upper portion 54. The slots 80 receive the outer pair of tabs 64 provided by the lower portion 52. More specifically, when the shipping restraint 10 is assembled, as illustrated best in FIGS. 1–3, the semi-circular projections 68 extend through the slots 80 in the upper portion 54 while the upper surface of the rectangular base 66 of the outer tabs 64 engages the underside of the upper portion 54 and is generally parallel to the slots 80.

The second end 32 includes a pair of perforated fold lines 82 and has a distal portion 84 which is adapted to rest upon the upper surface of the lower portion 52 of the main section 34. A pair of open-ended slots 86 formed in the distal portion 84 receive the notched bottom edge 70 of the outer pair of tabs 64 and help retain the shipping restraint 10 in an assembled condition, as will be described hereafter.

The reinforcement member 12, as shown best in FIG. 1, integrally includes a pair of lateral side panels 90 and an intermediate rear panel 92. Each of the side panels 90 includes a downwardly-extending tab (not shown) which extends through the slot 80 in the upper portion 54. The upper surfaces of the side and rear panels 90, 92 cooperate to define a support surface which underlies and supports an upper portion of a shipping box 100 surrounding the gas or electric range 14.

The shipping restraint 10 and reinforcement member 12 may be assembled or mounted on a gas or electric range in numerous different ways. One preferred method is accomplished by folding the outer tabs 64 upwardly away from the lower portion 52, folding the inner tabs 62 downwardly away from the lower portion 52 and inserting the ear members 63 into the slots 65. A pair of oven racks 102 are thereafter placed on the lower portion 52 such that the outer tabs extend between rails of the racks 102. Various other necessary accessories, such as broiler pans, anti-tip brackets, and finishing parts, may be placed upon the lower portion 52.

The upper portion 54 is folded over toward the lower portion 52, and the slots 86 of the second end 32 are pushed up around the notched bottom edge 70 of the outer tabs 64 to secure the upper and lower portions together. Simultaneously, the tabs 64, 76, and 78 are bent upwardly, and the semicircular projections 68 of the outer tabs 64 are inserted through the slots 80 in the upper portion.

The lower portion 52 is placed in engagement with the range main top panel 22 such that the inner tabs 62 rest upon the upper surface of the main top panel 22. If possible, the top panel 22 is raised to allow the distal portion 60 of the lateral tabs 58 to be inserted between the top panel 22 and the upper surface of the cabinet 16. Otherwise, the distal portions 60 hang down in front of the appliance. The top panel 22 is closed, and the main section 34 is adhesively secured to the top panel 22 and the lateral sidewalls 18 of the cabinet 16 with adhesive tape (not shown) at the notched recesses 72.

The oven door 20 is opened, and the first end 30 is bent at the fold lines 36, 37 to place the proximal portion 50 in a generally vertical plane and the mid-portion 44 in a generally horizontal plane. The distal portion 38 of the first end 30 extends into the oven a short distance, preferably to a location slightly behind the position of the door when closed. The outer portions 48 of the ears 42 are bent downwardly.

As the door 20 is closed, the mid-portion 44 and distal portion 38 cover the top edge of the door while the outer portion 48 of the ears 42 covers and protects the corners of the door 20. The door handle 26 is generally covered or concealed by the first end 30 of the shipping restraint 10. If the appliance includes a door locking device typical for self-cleaning models, the locking device may be deployed and will extend through the aperture 40 in the distal portion 38. As such, the oven door 20 and door handle 26 are protected, and the proximal portion 50 is in position to engage and help stiffen the front portion of the shipping box 100.

Thereafter, the reinforcement member 12 is secured to the shipping restraint 10, as discussed previously. Naturally, the present invention is intended for use in conjunction with various other shipping devices and techniques, and cooperates with these other devices and techniques to render the safe shipment of household ranges more cost effective.

The main section 34 is preferably dimensioned such that it extends across the entire interior of the shipping box 100.

The main section 34 thereby gives the box 100 greater side-to-side compression resistance to protect the range 14 from clamp truck handling. As mentioned hereinbefore, the reinforcement member 12 may not be necessary for certain appliance models. If the reinforcement member is not used, the tabs 76, 78 cooperate to support the upper wall of the box 100.

It is contemplated that various rearrangements, modifications, and substitutions of parts may be employed without departing from the scope and spirit of the present invention. Therefore, the present invention is not to be limited to the presently preferred embodiment specifically described herein, but rather is only to be defined by the claims appended hereto.

What is claimed is:

1. A shipping restraint in combination with a domestic appliance, said appliance having a cabinet and a movable panel, said shipping restraint comprising:

a first end received between said cabinet and said movable panel;

a second end opposite said first end and operable to space a portion of said shipping restraint a distance from said appliance;

a main section intermediate said first and second ends and including said portion, said main section including means for releasably retaining an appliance accessory on said main section during shipment.

2. A shipping restraint in combination with a domestic appliance according to claim 1, wherein said shipping restraint further comprises a reinforcement member, said reinforcement member being removably attached to said main section and extending upwardly therefrom.

3. A shipping restraint in combination with a domestic appliance according to claim 1, wherein the movable panel is a pivotally mounted door and said first end is received within said door.

4. A shipping restraint in combination with a domestic appliance according to claim 1, wherein said main section includes a tab and a slotted aperture, said tab extending upwardly through said aperture.

5. A shipping restraint in combination with a domestic appliance according to claim 4, wherein said shipping restraint further comprises a reinforcement member, said reinforcement member being removably attached to said main section and extending upwardly therefrom.

6. A shipping restraint in combination with a domestic appliance according to claim 5, wherein said reinforcement includes a projection that extends through the slotted aperture in the main section.

7. A shipping restraint in combination with a domestic appliance according to claim 6, wherein the movable panel is a pivotally mounted door and said first end is received within said door.

* * * * *